United States Patent [19]

Janatka

[11] Patent Number: 4,995,934

[45] Date of Patent: Feb. 26, 1991

[54] WICKING APPARATUS FOR ENVELOPES

[75] Inventor: Karel Janatka, Southbury, Conn.

[73] Assignee: Pitney Bowes Inc., Stamford, Conn.

[21] Appl. No.: 374,715

[22] Filed: Jul. 3, 1989

[51] Int. Cl.[5] ..... B43M 5/04; B43M 3/04

[52] U.S. Cl. ..... 156/441.5; 156/442.1; 156/443; 156/578; 118/32; 118/253; 118/264; 118/266

[58] Field of Search ..... 156/578, 441.5, 442.1, 156/443; 118/32, 253, 264, 268

[56] References Cited

U.S. PATENT DOCUMENTS

| | | | |
|---|---|---|---|
| 1,987,813 | 1/1935 | Allen | 118/32 |
| 2,028,277 | 1/1934 | Finfrock . | |
| 2,095,038 | 10/1937 | Ragot . | |
| 2,629,358 | 2/1953 | Krueger | 118/253 |
| 3,000,349 | 9/1961 | Ritzerfeld et al. . | |
| 3,905,325 | 9/1975 | Labore et al. | 156/441.5 X |
| 4,773,962 | 9/1988 | Garrigue et al. | 156/441.5 |
| 4,799,989 | 1/1989 | Marzullo | 156/442.1 |

*Primary Examiner*—Michael W. Ball
*Assistant Examiner*—Jeff H. Aftergut
*Attorney, Agent, or Firm*—Charles R. Malandra, Jr.; David E. Pitchenik; Melvin J. Scolnick

[57] ABSTRACT

A wicking apparatus for supplying moisture to a sheet document. The apparatus includes: a housing; a reservoir secured to the housing for storing a supply of water; a wicking unit secured to the housing, the unit having a lower, inclined surface, an inlet leading to the inside of the unit, and an interior channel leading from the inlet to the inclined surface; a wicking material situated on the inclined surface and adjacent the interior channel, the wicking material extending beyond the inclined surface; a device for urging a sheet document into contact with the wicking material; and a device for supplying water under pressure to the wicking material.

7 Claims, 4 Drawing Sheets

42
46
38
32
78
44
36
48
50
51
49
26
84
88
80

WICKING APPARATUS FOR ENVELOPES

The instant invention relates to apparatus for moistening the flap of an envelope, and more particularly, to wicking apparatus for delivering water to the envelope flap.

In mail handling machines, moistening devices are used to wet the flap of an envelope in preparation for sealing the envelope. Conventionally, this wetting is done by feeding the envelopes past a stripper blade having a moistening wick associated therewith, which allows the wick to come into contact with the glue on the envelope flap. The water causes the glue to soften and become tacky to the touch. The envelopes are then fed between two sealing rollers which press the flap against the envelope body to form the seal. The envelope is then either ejected into a stacker or passed on to another part of the mail handling machine for further processing.

In commercial moisteners for wetting envelope flaps, a wick is used to draw water from a tank and transfer it to the envelope flap. One particular drawback associated with the use of a wick is that frequently an insufficient amount of water is delivered to the envelope, which could be caused by (a) the water level dropping during use of the wick and the wick being unable to draw the water fast enough, or (b) a steady run of long envelopes which reduces the time the wick can replenish its water, or (c) the speed of the system may be such that the moistener design cannot supply the necessary water. Other drawbacks associated with wicking systems are that the tanks tend to spill water, the wicks tend to dry out, and the wick may become clogged. The instant invention therefore provides apparatus which assures that an ample supply of water is delivered to the wicking material, without the prior art problem of spilling, clogging or drying.

SUMMARY OF THE INVENTION

Accordingly, the instant invention provides a wicking apparatus for supplying moisture to a sheet document. The apparatus comprises: a housing; a reservoir secured to the housing for storing a supply of water; a wicking unit secured to the housing, the unit having a lower, inclined surface, an inlet leading to the inside of the unit, and an interior channel leading from the inlet to the inclined surface; a wicking material situated on the inclined surface and adjacent the interior channel, the wicking material extending beyond the inclined surface; means for urging a sheet document into contact with the wicking material; and means for supplying water under pressure to the wicking material.

DESCRIPTION OF THE PREFERRED EMBODIMENT

Figure 1:
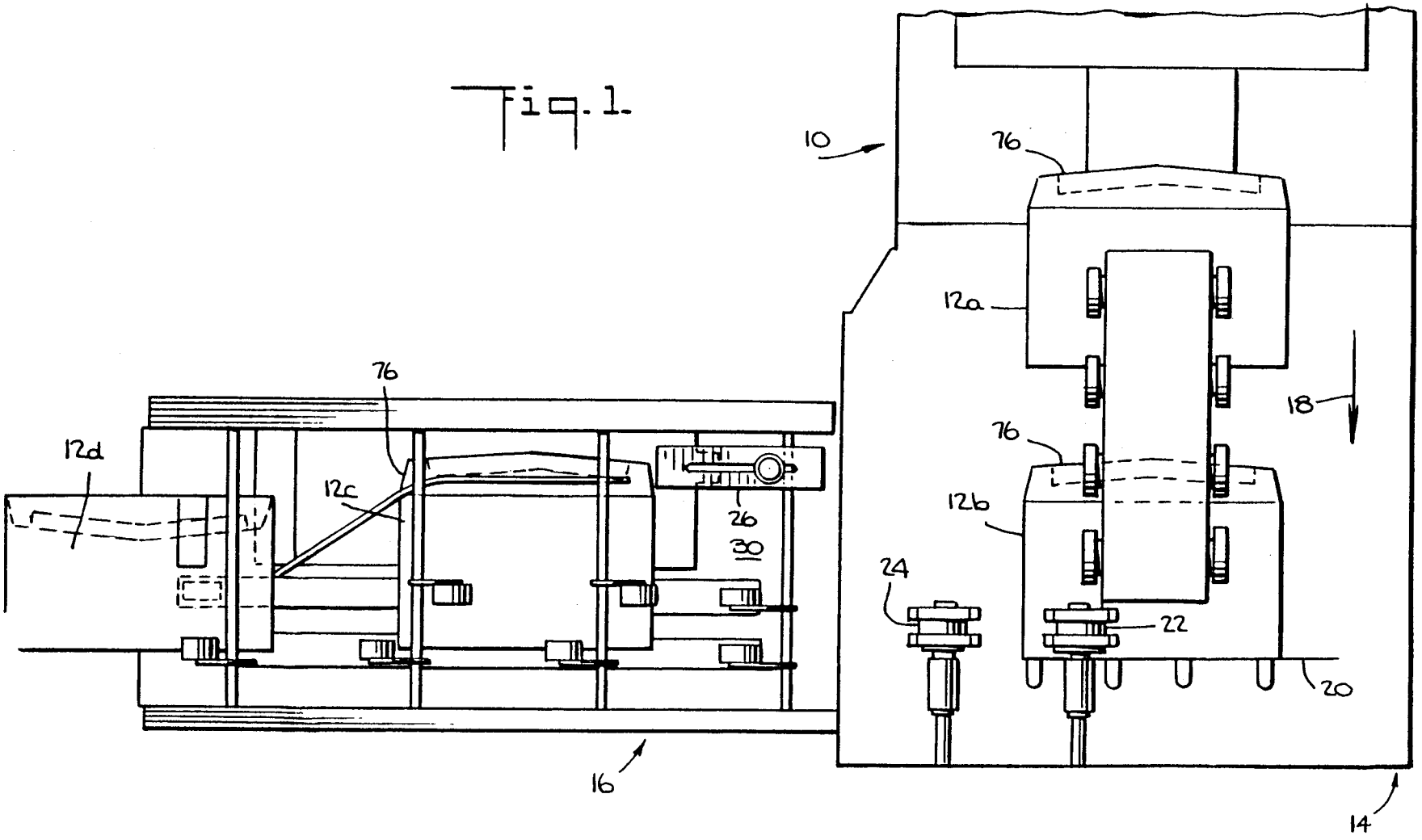
FIG. 1 is a top, plan view of an inserting apparatus, an envelope transport, and a sealing unit employing a wicking apparatus in accordance with the instant invention.

In describing the preferred embodiment of the instant invention, reference is made to the drawings, wherein there is seen in FIG. 1 an arrangement of a conventional document inserting device 10 which feeds documents (not shown) into envelopes, an envelope transport 14, and a sealing unit 16. In the inserter 10, envelopes 12*a* and 12*b* are seen moving in a direction indicated by the arrow 18 toward a registration wall 20. The envelopes 12*a* and 12*b* are then transported in a perpendicular direction by a pair of transport rollers 22 and 24 toward the sealing unit 16, which contains a wicking device 26, which is discussed in further detail hereinbelow.

Figures 2, 5:
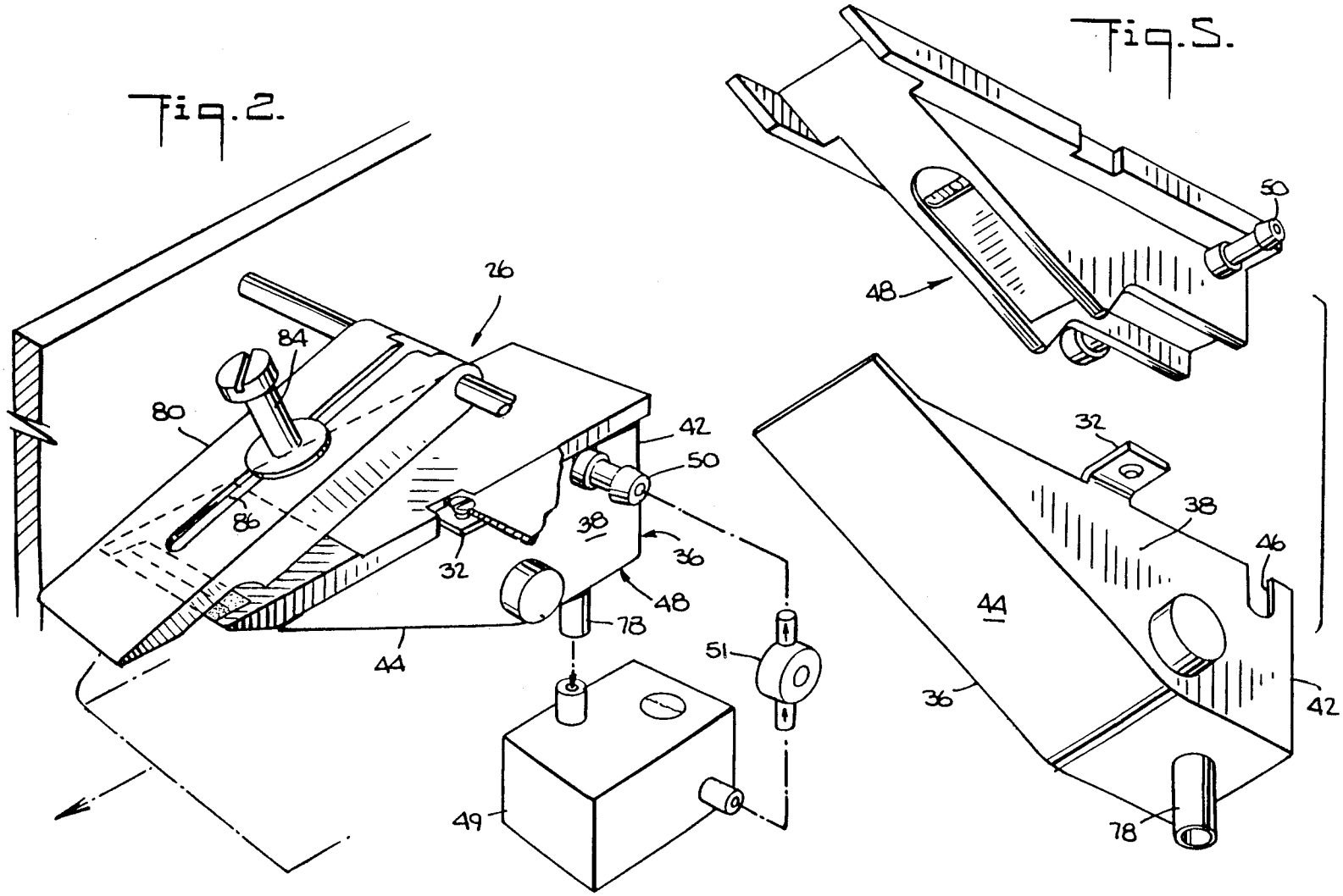
FIG. 2 is a perspective view of the wicking apparatus seen in FIG. 1.
FIG. 5 is a perspective view of the base and chamber module of the wicking apparatus seen in FIG. 2.
Figure 3:
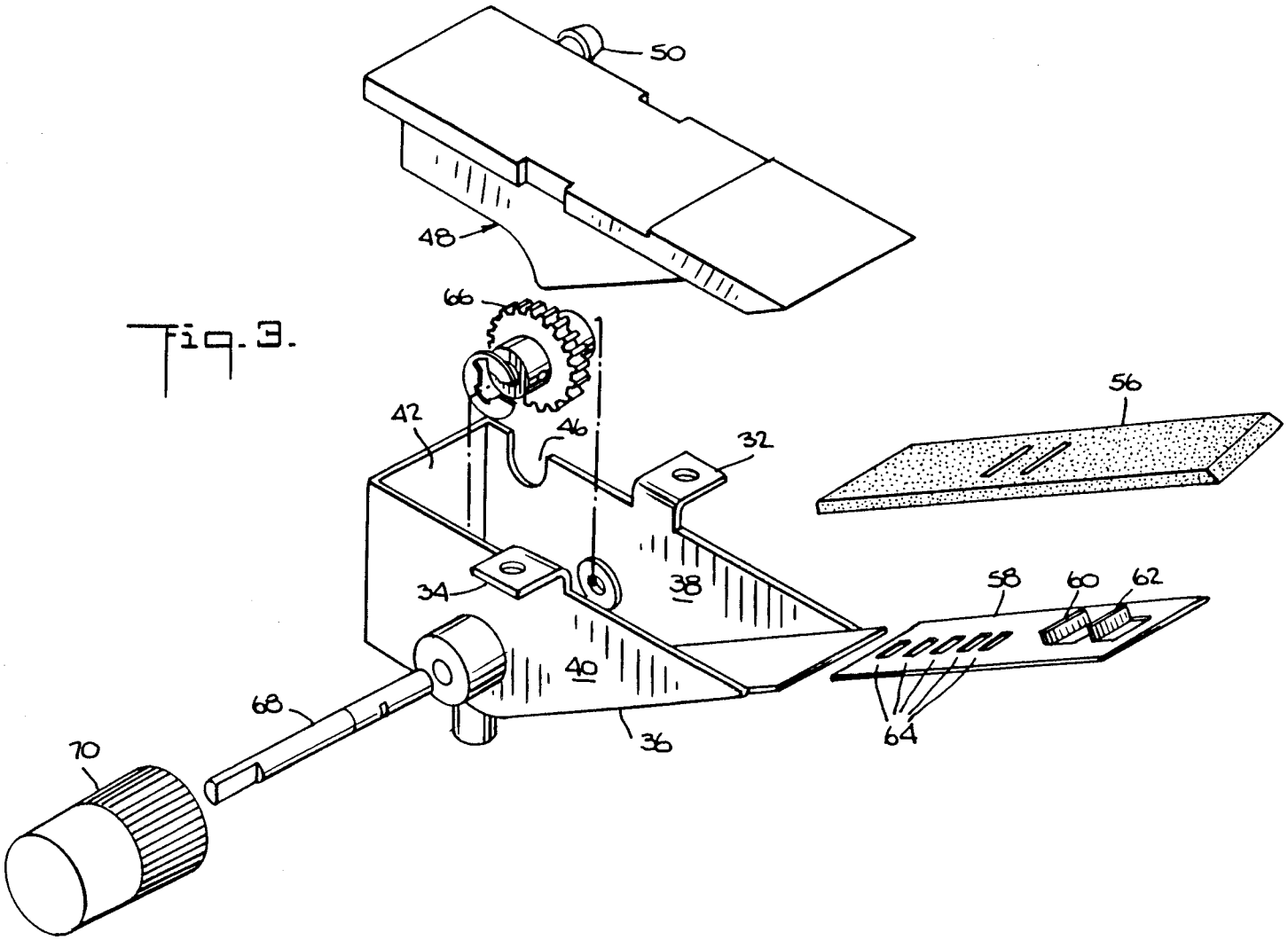
FIG. 3 is an exploded view of the wicking apparatus seen in FIG. 2 but without the deflector assembly.
Figure 4:
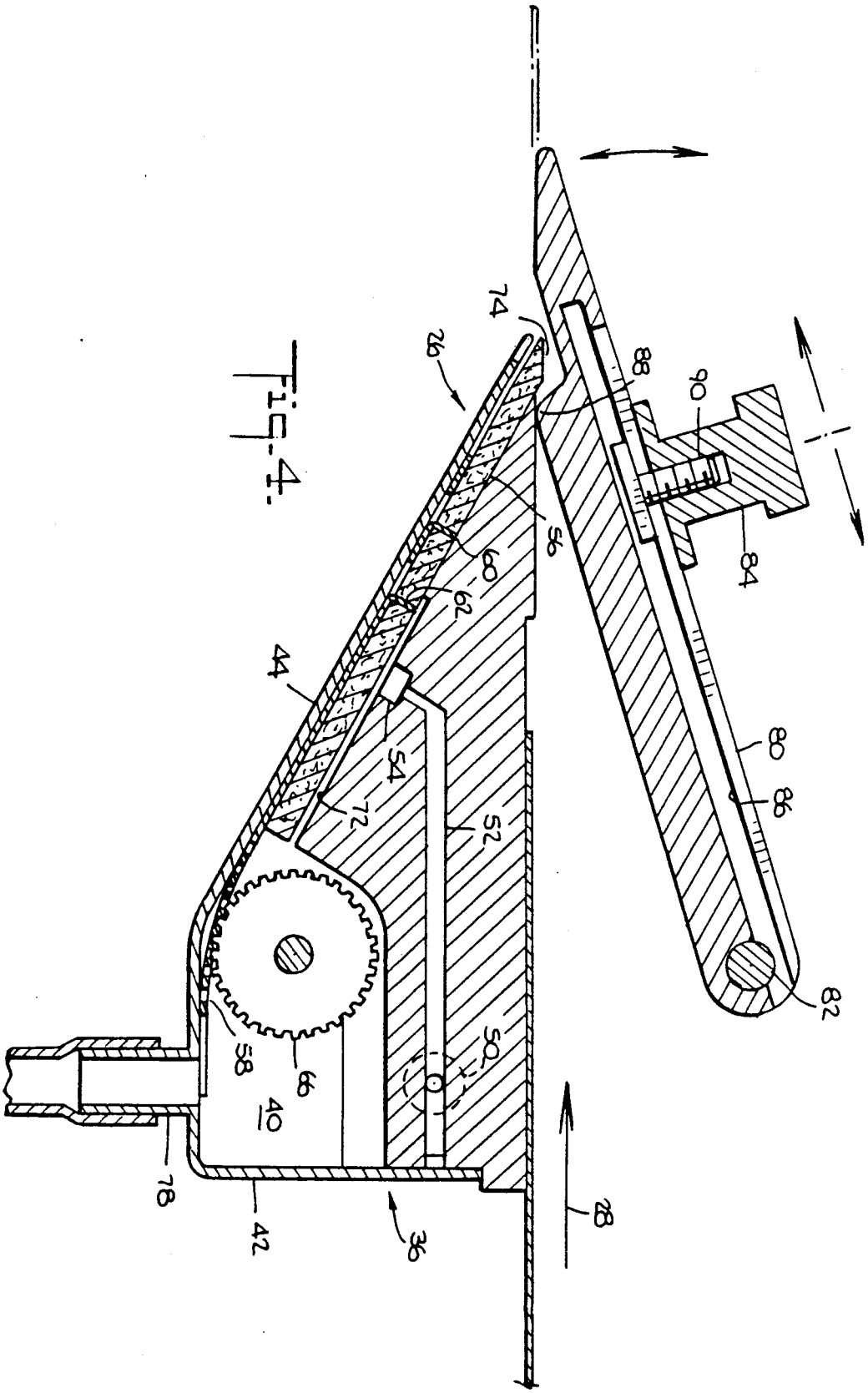
FIG. 4 is a vertical, sectional view of the wicking apparatus seen in FIG. 2.

Referring now to FIG. 4, there is seen, in section, the wicking device 26, with the envelope path indicated by the arrow 28. The wicking device 26 is mounted in the deck 30 of the sealing unit 16 by means of tabs 32 and 34 (see FIG. 3). The wicking device 26 includes a base 36 which is defined by a pair of sidewalls 38 and 40, a rear wall 42 and an inclined surface 44. The tabs 32 and 34 extend from the sidewalls 38 and 40 respectively. The base 36 further includes a U-shaped aperture 46 in the sidewall 40. The wicking device 26 further includes a chamber module 48 having an inlet 50 which allows water to enter the module 48, the water being supplied from a reservoir 49 having a pump 51 (see FIG. 2). The water moves through a channel 52 located within the chamber module 48. Water is then distributed under pressure at a port 54 so that it penetrates a wick 56, which is secured to a flexible holding member 58 by means of a pair of tabs 60 and 62. The holding member 58 is seated on the inclined surface 44 and includes a rack of slots 64 (see FIG. 3) which are engaged by a pinion gear 66 which is secured to a shaft 68 having attached at its end a handle 70 for rotation thereof. Thus, when the holding member 58 is moved within the channel 72 defined between the inclined surface 44 and the walls of the chamber module 48, the member 58 follows the channel 72 and the uppermost section 74 of the wick 56 is appropriately positioned to engage the gummed flap 76 of the envelopes 12*a–d* moving along the predefined path. The wicking base 36 also includes a drain port 78 which directs overflow water back into the reservoir 49.

Situated above the base 36 and chamber module 48 is a deflector assembly 80 pivotably mounted on a shaft 82 secured to the sealing unit 16. An adjustable weight assembly 84 is slidably mounted in an elongated, T-shaped slot 86. With heavier envelopes the weight assembly 84 would be moved downward in the slot 86 and for lighter envelopes the weight assembly 84 would be moved upward in the slot 86. The envelope flap is engaged by the arcuate portion 88 of the deflector assembly 80 which is directly affected by the location of the weight assembly 84 in the slot 86. The weight assembly 84 includes a screw 90 which engages an internal, threaded portion of the weight assembly 84, and the head of the screw 90 acts as a clamp when the weight assembly 84 is tightened against the deflector assembly 80.

From the foregoing, it can be seen that water under pressure is focused on the wick 56 approximately in the middle thereof, rather than at the bottom, and that ample water can always be supplied to the wick 56. Moreover, owing to the design of the wicking device 26, there is no clogging or drying of the wick 56.

It should be understood by those skilled in the art that various modifications may be made in the present invention without departing from the spirit and scope thereof, as described in the specification and defined in the appended claims.

What is claimed is:

1. A wicking apparatus for supplying moisture to a envelope, comprising:

a housing;

a reservoir secured to said housing for storing a supply of water;

a wicking unit secured to said housing, said unit having a lower, inclined surface, an inlet leading to the inside of said units and an interior channel leading from said inlet to said inclined surface;

a wicking material situated on said inclined surface and adjacent said interior channel, said wicking material extending beyond said inclined surface;

means for urging an envelope into contact with said wicking material; and means for directly applying water under pressure to penetrate said wicking material.

2. The apparatus of claim 1, wherein said urging means comprises a deflector assembly having an adjustable weight.

3. The apparatus of claim 1, wherein said water pressure means comprises a pump.

4. The apparatus of claim 1, wherein said wicking unit includes a base including said inclined surface and a chamber module including said inlet and said interior channel.

5. The apparatus of claim 4, additionally comprising a holding member seated on said inclined surface for securing said wick.

6. The apparatus of claim 5, additionally comprising means for moving the wick to an appropriate position for contacting said sheet document.

7. A wicking apparatus for supplying moisture to an envelope, comprising:

a housing;

a reservoir secured to said housing for storing a supply of water;

a wicking unit secured to said housing, said unit having a lower, inclined surface, an inlet leading to the inside of said unit and an interior channel leading from said inlet to said inclined surface;

a wicking material positioned on said inclined surface and adjacent said interior channel, said wicking material being extendable beyond an open end of said inclined surface for moistening flaps of passing envelopes;

means for adjusting the position of said wicking material along said inclined surface;

means for directly applying water under pressure to penetrate said wicking material; and means for adjustably urging an envelope flap into contact with said winking material.

* * * * *